US005228744A

United States Patent [19]

Sugiyama

[11] Patent Number: 5,228,744

[45] Date of Patent: Jul. 20, 1993

[54] APPARATUS FOR LOCKING OPERATIVE POSITION OF EACH FURNITURE ON FURNITURE RAISING/LOWERING TYPE FLOOR EQUIPMENT

[75] Inventor: Noboru Sugiyama, Tokyo, Japan

[73] Assignee: Kabushiki Kaisha Kotobuki, Tokyo, Japan

[21] Appl. No.: 813,974

[22] Filed: Dec. 26, 1991

[30] Foreign Application Priority Data

Dec. 27, 1990 [JP] Japan ..... 2-406908

[51] Int. Cl.[5] ..... A47C 9/06

[52] U.S. Cl. ..... 297/15; 297/345

[58] Field of Search ..... 297/15, 14, 345, 344, 297/316, 326, 330, 334; 296/66

[56] References Cited

U.S. PATENT DOCUMENTS

| | | | |
|---|---|---|---|
| 853,893 | 5/1907 | Miller | 297/15 |
| 1,062,010 | 5/1913 | Jacobson | 297/15 X |
| 3,025,106 | 3/1962 | Evans et al. | 297/15 X |
| 4,562,046 | 3/1987 | Compagnone | 297/15 |

*Primary Examiner*—Laurie K. Crammer

*Attorney, Agent, or Firm*—Oldham, Oldham & Wilson Co.

[57] ABSTRACT

An apparatus for locking an operative position of each furniture such as a chair or the like on a furniture raising/lowering floor equipment wherein the furniture is mounted on a raising/lowering unit vertically displaceably arranged in the furniture accommodating chamber and the operative position of the furniture is reached when the raising/lowering unit is fully raised up and the furniture is then tilted is disclosed. The apparatus includes as essential components a triangular link plate turnably supported on a rotational shaft transversely projecting from the raising/-lowering unit, a support shaft for the furniture turnably arranged on the rotational shaft, an opposing pair of substantially inverted U-shaped turnable engagement pieces, and a pair of joint links bridged between the link plate and the engagement pieces. The raising/lowering unit is provided with engagement projections on the opposite sides at the upper end thereof and a stopper pin at the intermediate position at the lower end thereof. The engagement projections come in contact with the lower surfaces of the frames of the furniture accommodating chamber and the stopper on the link plate collides with the stopper pin on the raising/lowering unit, when the raising/-lowering unit is fully raised up in the furniture accommodating chamber.

2 Claims, 2 Drawing Sheets

APPARATUS FOR LOCKING OPERATIVE POSITION OF EACH FURNITURE ON FURNITURE RAISING/LOWERING TYPE FLOOR EQUIPMENT

BACKGROUND OF THE INVENTION

1. Field of the Invention

The present invention relates to an apparatus for locking an operative position of each furniture to be accommodated in a furniture accommodating chamber of a furniture raising/lowering type floor equipment. More particularly, the present invention relates to an apparatus for locking an operative position of each chair in an tilted state on the furniture raising/lowering type floor equipment.

2. Description of the Related Art

In recent years, a building such as a hall, a theater, a gymnasium or the like has been increasingly utilized in a multi-purposed fashion. To this end, research and development works have been conducted for providing various kinds of floor equipments. As is well known, this kind of floor equipments are roughly classified into two types, i.e., an expansible/contractive platform displacement type floor equipment and a furniture raising/lowering type floor equipment. In practice, the present invention is concerned with the latter type of floor equipment, i.e., the furniture raising/lowering type floor equipment. With respect to the floor equipments as mentioned above, there has been seen a general tendency that when a plurality of furnitures such as chairs or the like are not in use, they are accommodated in a furniture accommodating chamber of the floor equipment below the floor surface of the building and when they are in use, they are raised upward of the furniture accommodating chamber of the building by raising up a raising/lowering unit with the aid of a driving mechanism so as to allow audiences to enjoy a performance while sitting on their own chairs.

However, as far as the conventional floor equipment as constructed in the above-described manner is concerned, since a structure for firmly holding chairs or the like at the operative position is complicated, and moreover, handling of the conventional floor equipment is time-consuming, there have been raised many requests for providing an apparatus exclusively employable for the purpose of locking an operative position of each furniture independently of a main actuating system for the floor equipment wherein a locking operation is reliably performed with the apparatus. It should be emphasized that few attention has been hitherto paid to an apparatus for locking an operative position of each furniture such as a chair or the like in the furniture raising/lowering floor equipment.

SUMMARY OF THE INVENTION

The present invention has been made with the foregoing background in mind.

An object of the present invention is to provide an apparatus for locking an operative position of each furniture such as a chair or the like to be accommodated in a furniture accommodating chamber of a furniture raising/lowering type floor equipment wherein the apparatus is simple in structure and handling of the apparatus is easy for any user such as an audience or the like.

Another object of the present invention is to provide an apparatus for locking an operative position of each furniture such as a chair or the like to be accommodated in a furniture accommodating chamber of a furniture raising/lowering type floor equipment wherein the furniture can manually be locked at a predetermined position on the floor equipment without any necessity for arranging an actuator or similar means.

According to the present invention, there is provided an apparatus for locking an operative position of each furniture to be accommodated in a furniture accommodating chamber of a furniture raising/lowering type floor equipment wherein the furniture is mounted on a raising/lowering unit vertically displaceably arranged in the furniture accommodating chamber and the operative position of the furniture is reached when the raising/lowering unit is fully raised up and the furniture is then tilted, wherein the apparatus comprises a triangular link plate turnably supported on a rotational shaft transversely projecting from the raising/lowering unit, the link plate including a stopper at a first corner and joint pins at second and third corners thereof; a support shaft for the furniture turnably arranged on the rotational shaft of the raising/lowering unit and made integral with the link plate; an opposing pair of substantially inverted U-shaped turnable engagement pieces each including an inside projection and an outside projection adapted to come in contact with the upper surface of a frame arranged at the upper end of the furniture accommodating chamber by turning movement of the engagement pieces about a pin on the inside projection thereof; and the raising/lowering unit including engagement projections on the opposite sides at the upper end thereof and a stopper pin at the intermediate position at the lower, the engagement projections coming in contact with the lower surfaces of the frames of the furniture accommodating chamber and the stopper on the link plate colliding with the stopper pin on the link plate when the raising/lowering unit is fully raised up in the furniture accommodating chamber.

To assure that the operative position of each furniture is reliably locked, when the raising/lowering unit is fully raised up and the support rod is tilted to the operative position of the furniture, lines extending between the joint pins at the second and third corners of the link plate and joint pins on the inside projections of the engagement pieces are slightly offset from lines extending between the center of the rotational shaft and the joint pins on the inside projections of the engagement pieces to build a toggle mechanism among the link plate, the joint links and the engagement pieces. Thus, the operative position of the furniture can reliably be locked, while the frames are clamped between the outside projections of the engagement pieces and the engagement projections of the raising/lowering unit, and moreover, the stopper on the link plate collides with the stopper pin on the raising/lowering unit.

Other objects, features and advantages of the present invention will become apparent from reading of the following description which has been made in conjunction of the accompanying drawings.

BRIEF DESCRIPTION OF THE DRAWINGS

The present invention is illustrated in the following drawings in which.

DESCRIPTION OF THE PREFERRED EMBODIMENT

Figure 1:
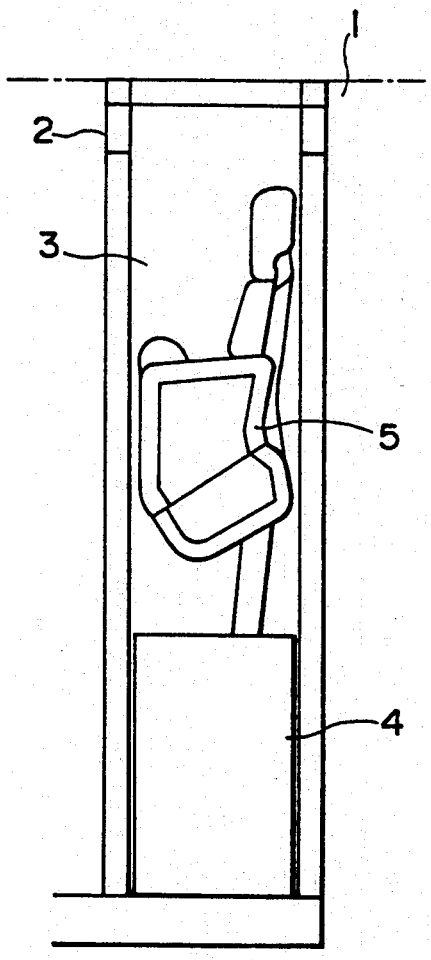
FIG. 1 is a vertical sectional side view of a furniture raising/lowering type floor equipment, particularly illustrating that a chair is accommodated in a furniture accommodating chamber of the furniture raising/lowering type floor equipment together with a raising/lowering unit.

Now, the present invention will be described in detail hereinafter with reference to the accompanying drawings which illustrate a preferred embodiment of the present invention. In this embodiment, an array of chairs are used as furnitures. However, for the purpose of simplification of illustration, only a single chair is shown in the drawings.

The drawings illustrate the embodiment of the present invention wherein an apparatus of locking an operative position of each furniture to be accommodated in a furniture accommodating chamber of a furniture raising/lowering type floor equipment is employed for an array of chairs.

In the drawings, reference numeral 1 designates a furniture raising/lowering type floor equipment (hereinafter referred simply as a floor equipment) for a building such as a hall, a theater, a gymnasium or the like. Referring to FIG. 1, a chair 5 is accommodated in a furniture accommodating chamber 3. The furniture accommodating chamber 3 is formed in the hollow space defined by frames 2 of the floor equipment 1.

Reference numeral 4 designates a raising/lowering unit which is vertically displaceably accommodated in the furniture accommodating chamber 3. As a driving mechanism (not shown) is actuated, the raising/lowering unit 4 having a chair 5 mounted thereon is displaced in the furniture accommodating chamber 3 in the upward/downward direction so that the chair 5 is raised upward of the floor surface of a building or lowered downward of the same. The raising/lowering unit 4 includes a pair of engagement portions 6 on the opposite sides at the lower end thereof so that the engagement portions 6 come in engagement with the lower surfaces of frames 2.

Reference numeral 7 designates a rotational shaft. The rotational shaft 7 is rotationally supported on the raising/lowering unit 4 projecting from the same so as to simultaneously turn a triangular link plate 8 and a support rod 9 of which upper end is fixedly secured to the chair 5.

Reference numeral 10 designates an opposing pair of substantially inverted U-shaped engagement pieces. Each engagement piece 10 includes an inside projection 11 of which lower end is turnably supported on the raising/lowering unit 4 to turn about a shaft 12. In addition, the engagement piece 10 includes an outside projection 13 adapted to come in engagement with the frame 2.

Figure 3:
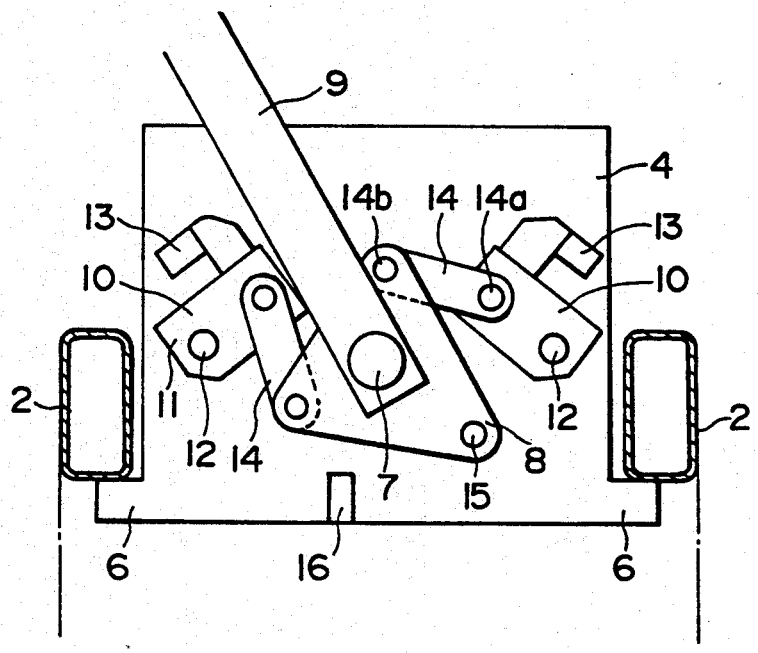
FIG. 3 is an enlarged fragmentary side view of an apparatus for locking an operative position of each furniture such as a chair or the like to be accommodated in a furniture accommodating chamber of a furniture raising/ lowering type floor equipment in accordance with an embodiment of the present invention, particularly illustrating that a support rod for the furniture is held in an unlocked state.

Reference numeral 14 designates a link of which one end is pivotally connected to the engagement piece 10 via a pin **14*a* and of which other end is pivotally connected to the link plate 8 via a pin 14*b*. As the link plate 8 turns about the rotational shaft 7 in the clockwise direction as seen in FIG. 3, the engagement pieces 10 operatively associated with the link plate 8 via the links 14 turn about the shafts 12** each of which serves as a fulcrum.

Reference numeral 15 designates a stopper which transversely projects from the link plate 8. As the link plate 8 turns about the rotational shaft 7 in the clockwise direction, the stopper 15 is brought in engagement with a stopper pin 16 which is located on the locus of turning movement of the stopper 15 at the lower end of the raising/lowering unit 4.

Figure 2:
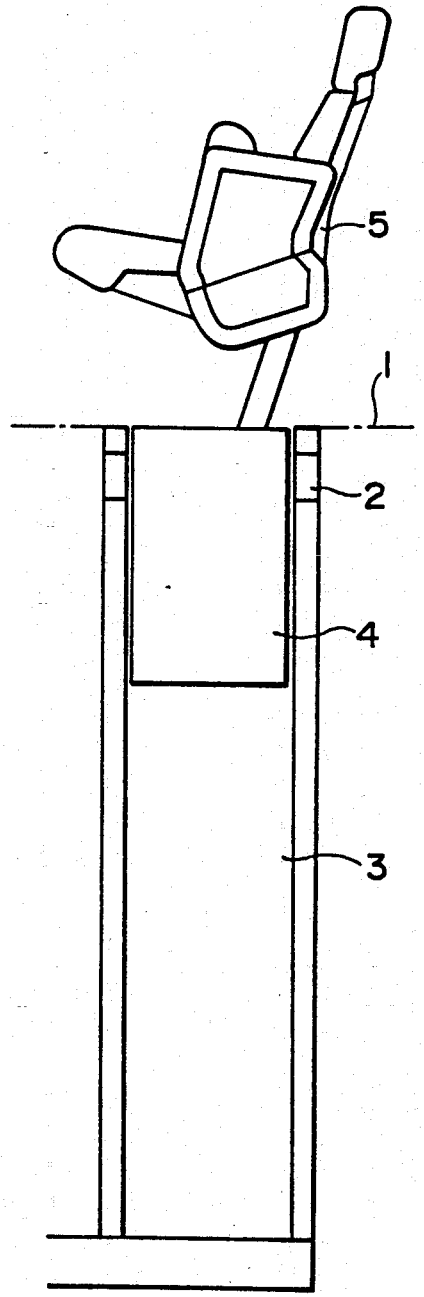
FIG. 2 is a vertical sectional view of the furniture raising/lowering type floor equipment, particularly illustrating that the chair is raised up in an inclined state on the floor surface of a building.
Figure 4:
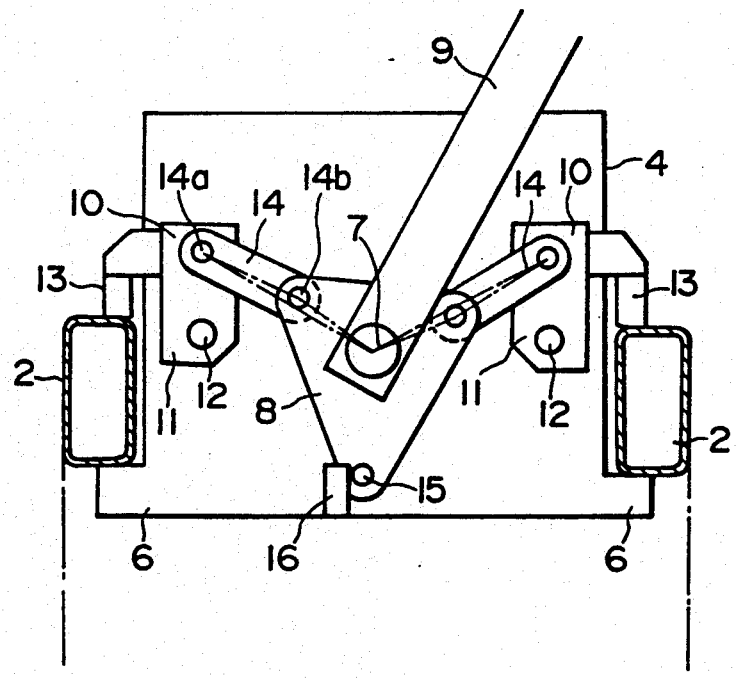
FIG. 4 is an enlarged fragmentary side view of the apparatus shown in FIG. 3, particularly illustrating that the support rod for the furniture is held in a locked state when the furniture is fully raised up on the floor surface of a building.

Since the apparatus of the present invention is constructed in the above-described manner, to raise up the chair 5 on the floor surface of the building to assume an operative attitude away from an accommodated attitude in which the chair 5 has been downwardly folded and accommodated in the furniture accommodating chamber 3 as shown in FIG. 1, first, the raising/lowering unit 4 is raised up by actuating the driving mechanism (not shown). This causes the engagement portions 6 projecting from the raising/lowering unit 4 to come in contact with the lower surfaces of the frames 2, resulting in raising-up movement of the raising/lowering unit 4 to be interrupted. At this time, the raising/lowering unit 4 has assumed an intermediate operative state as shown in FIG. 3, Subsequently, the support rod 9 is turned about the rotational shaft 7 in the clockwise direction as seen in the drawing with an user's hand (not shown), whereby the chair 5 mounted on the raising/lowering unit 4 via the support rod 9 assumes an inclined state, i.e., an operative state as shown in FIG. 2. As the link plate 8 is turned together with the rotational shaft 7, the engagement pieces 10 are turned about the shafts 12 in the outward direction via the links 14 so that the outside projections 13 of the engagement pieces 10 are displaced toward the upper surfaces of the frames 2 to come in contact with the same. This causes each frame 2 to be clamped between the engagement portion 6 of the raising/lowering unit 4 and the outside projection 13 of the engagement piece 10. At the same time, the stopper 15 on the link plate 8 collides with the stopper pin 16 on the raising/lowering unit 4, resulting in the chair 5 being reliably locked as illustrated in FIG. 4. Thus, an operative position of the chair 5 can be locked by a clamping operation performed between the frames 2 and the projections 6 as well as collision of the stopper 15 with the stopper pin 15.

As long as the foregoing state is maintained while an audience sits on the chair 5, when an exterior force generated by resting his back against the chair 5 is exerted on the chair 5, a turning force effective in the rightward direction as seen in FIG. 4 acts on the support rod 9, causing the link plate 8 to turn further about the rotational shaft 7 in the clockwise direction. However, since the stopper 15 of the link plate 8 has been brought in engagement with the stopper pin 16 of the raising/lowering unit 4, further turning movement of the link plate 8 is prevented reliably. On the contrary, when a turning force effective in the rightward direction is exerted on the support rod 9 due to an audience's eccentric load exerted on the foremost end part of a sitting plate of the chair 5 or when a certain exterior force is exerted on the raising/lowering unit 4 so as to allow the raising/lowering unit 4 to be lowered, the link plate 8 is liable to turn about the rotational shaft 7. However, since the line extending between both the pins 14*a* and 14*b* of the link 14 is slightly offset above the line extending between the pin 14*a* of the link 14 and the center of the rotational shaft 7 thereby to build a toggle mechanism on the link plate 8, further turning movement of the link plate 8 is likewise prevented reliably. Consequently, since the outside projections 13 of the engagement pieces 10 are continuously brought in engagement with the upper surfaces of the frames 2, and moreover, the engagement portions 6 of the raising/lowering unit 4 are likewise continuously brought in engagement with the lower surfaces of the frames 2, both the frames 2 are reliably clamped between the outside projections 13 of the engagement pieces 10 and the engagement portions 6 of the raising/lowering unit 4 with the result that there is no possibility that the chair 5 moves unexpectedly or unintensionally and the raising/lowering unit 4 is lowered unexpectedly or unintensionally.

Next, when the foregoing locked state is to be released, the support rod 9 is turned from the positional state as shown in FIG. 4 in the anticlockwise direction with the aid of operator's hands, causing the link plate 8 to be turned about the rotational shaft 7 in the anticlockwise direction, whereby the stopper 15 is disengaged from the stopper pin 16. At the same time, each engagement piece 10 is turned about the shaft 12 in the inward direction so that the engagement pieces 10 are released from engagement with the frames 2. Consequently, since the raising/lowering unit 4 is entirely disengaged from the frames 2, the raising/lowering unit 4 can be lowered by actuating the driving mechanism (not shown) and the chair 5 can be accommodated in the furniture accommodating chamber 3. 5 It should be noted that the apparatus of the present invention should not limitatively be employed only for the aforementioned furniture accommodating structure but it may be employed as a position locking apparatus for a tilting mechanism for tilting an array of chairs.

As described above with respect to a single preferred embodiment of the present invention, since the apparatus is constructed such that the stopper of the link plate is brought in engagement with the stopper pin of the raising/lowering unit merely by turning the support rod for a furniture, and at the same time, the frames, i.e., stationary members can be locked with the outside projections of the engagement pieces in cooperation of the engagement portions of the raising/lowering unit, a locking operation can be performed very simply and easily. In addition, since the link plate is immovably held on the raising/lowering unit in cooperation of the stopper with the stopper pin after completion of the locking operation, the link plate can reliably be held in a locked state without any possibility that the locked state of the apparatus is unexpectedly or unintensionally released no matter how a load such as an exterior force or the like is exerted on the link plate.

In addition, when the locked state is to be released, it suffices that the rotational shaft is rotated in the reverse direction. According to the present invention, there is no necessity for a complicated structure of arranging an actuator exclusively employable for the purpose of locking independently of the apparatus. Thus, an advantageous effect of the present invention is that the apparatus can be constructed in simple structure with excellent rigidity.

While the present invention has been described above with a respect to a single preferred embodiment thereof, it should of course be understood that the present invention should not be limited only to this embodiment but various changes or modifications may be made without departure from the scope of the present invention as defined by the appended claims.

What is claimed:

1. An apparatus for locking in an operative position piece of each furniture accommodated in a furniture accommodating chamber of a furniture raising/lowering type floor equipment wherein said furniture is mounted on a raising/lowering unit vertically displaceably arranged in said furniture accommodating chamber and said operative position of said furniture is reached when said raising/lowering unit is fully raised up and said furniture is then tilted, wherein said apparatus comprises;

a triangular link plate turnably supported on a rotational shaft transversely projecting from said raising/lowering unit, said link plate including a stopper at a first corner and joint pins at second and third corners thereof, a support shaft for said furniture turnably arranged on said rotational shaft of said raising/lowering unit and made integral with said link plate, an opposing pair of substantially inverted U-shaped turnable engagement pieces each including an inside projection and an outside projection adapted to come in contact with an upper surface of a frame arranged at an upper end of said furniture accommodating chamber by turning movement of each said engagement piece about a pin on said inside projection thereof, a pair of joint links bridged between said link plate and said engagement pieces, and said raising/lowering unit including engagement projections on opposite sides at an upper end thereof and a stopper pin at an intermediate position at a lower end thereof, said engagement projections coming in contact with lower surfaces of said frame of said furniture accommodating chamber and said stopper on said link plate colliding with said stopper pin on said raising/lowering unit when said raising/lowering unit is fully raised up in said furniture accommodating chamber.

2. The apparatus as claimed in claim 1, wherein when said raising/lowering unit is fully raised up and said support rod is tilted to said operative position of said furniture, lines extending between said joint pins at the second and third corners of said link plate and joint pins on said inside projections of said engagement pieces are slightly offset from lines extending between the center of said rotational shaft and said joint pins on said inside projections of said engagement pieces to build a toggle mechanism among said link plate, said joint links and said engagement pieces, whereby said operative position of said furniture is reliably locked while said frame is clamped between said outside projections of said engagement pieces and said engagement projections of said raising/lowering unit, and moreover, said stopper on said link plate collides with said stopper pin on said raising/lowering unit.

* * * * *